United States Patent [19]

Huenniger

[11] Patent Number: 4,646,530

[45] Date of Patent: Mar. 3, 1987

[54] AUTOMATIC ANTI-SURGE CONTROL FOR DUAL CENTRIFUGAL COMPRESSOR SYSTEM

[75] Inventor: Edward A. Huenniger, Liverpool, N.Y.

[73] Assignee: Carrier Corporation, Syracuse, N.Y.

[21] Appl. No.: 881,426

[22] Filed: Jul. 2, 1986

[51] Int. Cl.[4] ..... F25B 7/00

[52] U.S. Cl. ..... 62/175; 62/217; 62/230; 62/510

[58] Field of Search ..... 62/175, 217, 230, 203, 62/204, 201, 117, 510, 226, 228.1, 228.5, 196.2, 196.3; 236/1 EA; 417/3, 5, 6, 7, 8; 415/17

[56] References Cited

U.S. PATENT DOCUMENTS

| | | | |
|---|---|---|---|
| 4,152,902 | 5/1979 | Lush | 62/157 |
| 4,282,718 | 8/1981 | Kountz et al. | 62/201 X |
| 4,487,028 | 12/1984 | Foye | 62/115 |
| 4,581,900 | 4/1986 | Lowe et al. | 62/228.1 |

*Primary Examiner*—Harry B. Tanner

*Attorney, Agent, or Firm*—Robert H. Kelly

[57] ABSTRACT

A control system for controlling the capacity of a lead compressor of a refrigeration system having a lead and lag compressor when the lag compressor is in surge. A microcomputer system receives electrical input signals indicative of the lead and lag motor currents and closes the inlet guide vanes of the lead compressor when the lag compressor percent motor amps are below the lead compressor motor amps by more than a selected percentage for a specified period of time.

6 Claims, 1 Drawing Figure

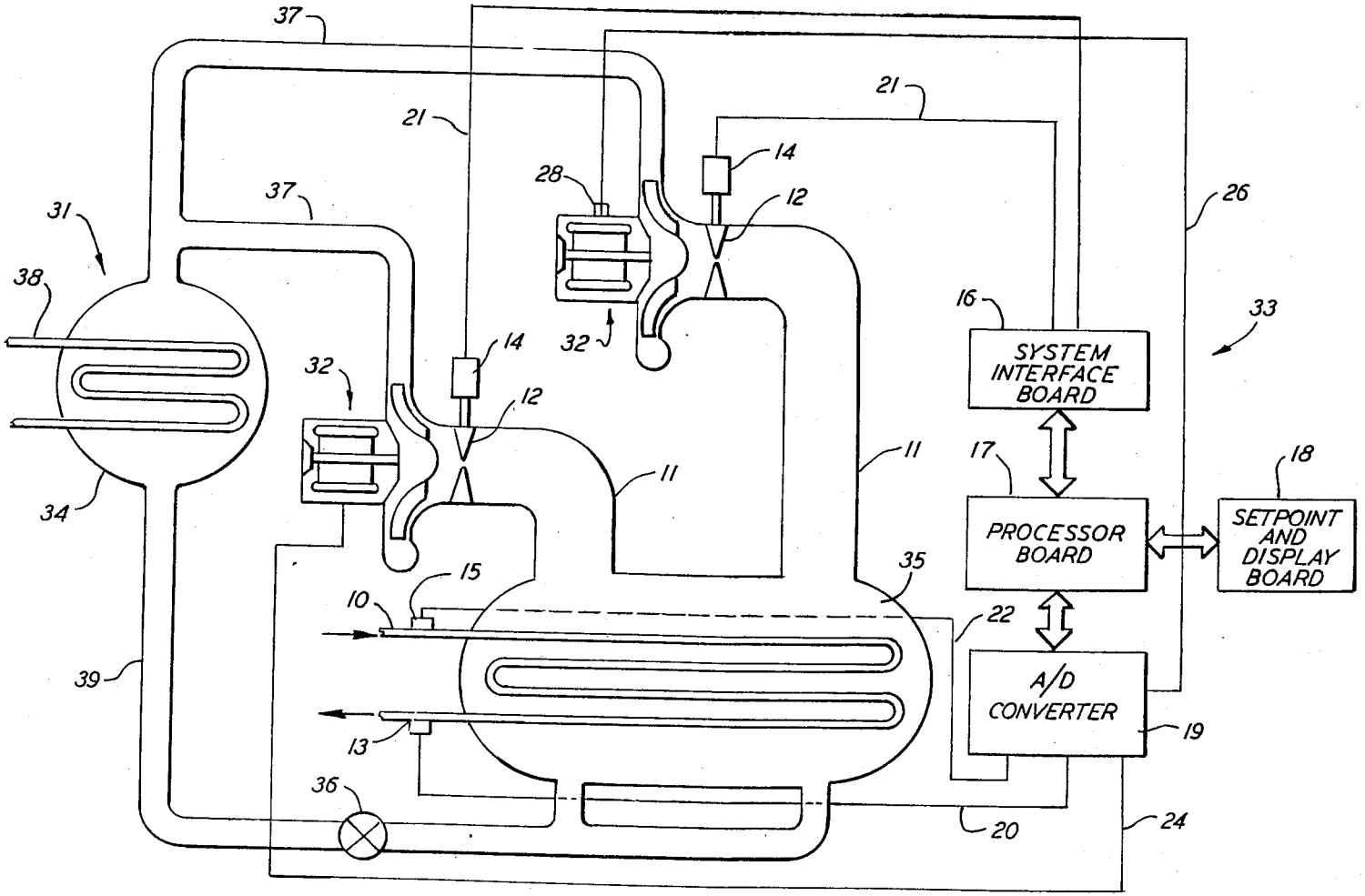
SETPOINT AND DISPLAY BOARD
SYSTEM INTERFACE BOARD
PROCESSOR BOARD
A/D CONVERTER
10
11
12
13
14
15
16
17
18
19
20
21
22
24
26
28
31
32
33
34
35
36
37
38
39

AUTOMATIC ANTI-SURGE CONTROL FOR DUAL CENTRIFUGAL COMPRESSOR SYSTEM

BACKGROUND OF THE INVENTION

The present invention relates to methods of operating and control systems for refrigeration systems and, more particularly, to methods of operating and control systems for surge control devices, such as compressor inlet guide vanes, in dual centrifugal vapor compression refrigeration systems whereby when one compressor begins to operate in a surge condition, the other compressor's guide vanes are closed.

Generally, refrigeration systems include an evaporator or cooler/chiller, a compressor, and a condenser. Usually, a heat transfer fluid is circulated through tubing in the evaporator thereby forming a heat transfer coil in the evaporator to transfer heat from the heat transfer fluid flowing through the tubing to refrigerant in the evaporator. The heat transfer fluid chilled in the tubing in the evaporator is normally water or glycol which is circulated to a remote location to satisfy a refrigeration load. The refrigerant in the evaporator evaporates as it absorbs heat from the heat transfer fluid flowing through the tubing in the evaporator, and the compressor operates to extract this refrigerant vapor from the evaporator, to compress this refrigerant vapor, and to discharge the compressed vapor to the condenser. In the condenser, the refrigerant vapor is condensed and delivered back to the evaporator where the refrigeration cycle begins again.

To maximize operating efficiency, it is desirable to match the amount of work done by the compressor to the work needed to satisfy the refrigeration load placed on the refrigeration system. Commonly, this is done by capacity control means which adjust the amount of refrigerant vapor flowing through the compressor. The capacity control means may be a device such as guide vanes which are positioned between the compressor and the evaporator which move between a fully open and a fully closed position in response to the temperature of the chilled heat transfer fluid leaving the coil in the evaporator. When the evaporator chilled heat transfer fluid temperature falls, indicating a reduction in refrigeration load on the refrigeration system, the guide vanes move toward their closed position, decreasing the amount of refrigerant vapor flowing through the compressor. This decreases the amount of work that must be done by the compressor thereby decreasing the amount of energy needed to operate the refrigeration system. At the same time, this has the effect of increasing the temperature of the chilled heat transfer fluid leaving the evaporator. In contrast, when the temperature of the leaving chilled heat transfer fluid rises, indicating an increase in load on the refrigeration system, the guide vanes move toward their fully open position. This increases the amount of vapor flowing through the compressor and the compressor does more work thereby decreasing the temperature of the chilled heat transfer fluid leaving the evaporator and allowing the refrigeration system to respond to the increased refrigeration load. In this manner, the compressor operates to maintain the temperature of the chilled heat transfer fluid leaving the evaporator at, or within a certain range of, a set point temperature.

Many different capacity control systems are known for controlling a refrigeration system in the manner described above. For example, one such control system, adjusts a capacity control device in a refrigeration system as a function of the deviation of leaving evaporator chilled water temperature from a desired set point temperature. When the evaporator chilled water temperature deviates from the selected set point temperature by a predetermined amount the capacity control device is continuously adjusted by an actuator which is continuously energized by a stream of electrical pulses supplied to the actuator.

However, with dual centrifugal compressor systems, where one compressor is designated "lead" and the other compressor is designated "lag", the compressors are generally controlled by monitoring the percent of full load electrical motor current of the lead compressor and by adjusting the guide vanes of the lag compressor, either open or closed, until the lag percent of full load motor current matches the lead compressor percent of full load motor current. When the lead compressor surges with this operating scheme the surge condition is generally alleviated, since, when the lead compressor surges, its motor current drops severely. When the lag compressor senses this it closes its guide vanes in an attempt to match the lead compressor's percent motor current. As a result, the refrigeration system's capacity is temporarily reduced, and the evaporator and condenser pressures approach each other, but, since the surge is caused by the system operating at too high a pressure difference, the surge is stopped.

When the lag compressor is the one that surges, however, the surge condition cannot be stopped with the prior art control scheme. When the lag compressor surges, causing machine capacity to drop off, the lead compressor whose guide vanes are controlled in response to leaving chilled water responds by opening its guide vanes in an attempt to restore system capacity. Accordingly, the cooler and condenser pressures do not approach each other, and the lag compressor would continue to surge indefinitely.

Thus, there exists a need to develop lead/lag control techniques for multiple centrifugal compressor machines, when the compressors are connected in parallel, which minimizes the disadvantages of controlling capacity in response to surging of the lag compressor by adjusting the guide vane of the lead compressor.

SUMMARY OF THE INVENTION

Therefore, it is an object of the present invention to provide a simple, efficient, and effective microcomputer system for controlling a multiple centrifugal compressor refrigeration machine in response to a surge condition of a lag compressor.

It is an object of the present invention to provide a control scheme for controlling a multiple centrifugal compressor refrigeration machine when the lag compressor percent motor amps are below the lead compressor motor amps by a certain number of percentage points for a certain period of time.

These and other objects of the present invention are attained by a surge control system for a multiple centrifugal compressor refrigeration machine comprising means for sensing a signal corresponding to the percent motor amps of the compressors, means for generating a first control signal which is a function of the motor amps of the lead compressor, means for generating a second control signal which is a function of the motor amps of the lag compressor, and processor means for receiving said first and second control signals for processing the received signals according to preprogrammed procedures and for generating an output control signal for controlling the operation of the guide vanes of the lead compressor in response to the output control signal.

The processor means, a microcomputer, determines the lead and lag motor currents and initiates a surge correction algorithm if the following conditions occur:

(a) If the lag current is less than the lead current by 20% for a period of two consecutive minutes, the lead guide vanes shall be closed for a period of up to three minutes.

(b) If the lag current does not increase by 10% during this period, the lag compressor shall execute a non recycle shutdown. The lead compressor guide vanes shall stop closing and revert to normal temperature control.

(c) If the lag current does not increase by equal or greater than 10% during the three minute "lead closing" period, the lead guide vanes shall immediately stop closing and revert to normal temperature control.

(d) Two surge corrections (closing the lead guide vanes) shall be allowed. On the third occurrence of the 20% difference for two consecutive minutes, the lag compressor shall execute a non-recycle shutdown and the lead compressor shall revert to normal temperature control.

BRIEF DESCRIPTION OF THE DRAWINGS

Still other objects and advantages of the present invention will be apparent from the following detailed description of the present invention in conjunction with the accompanying drawing in which:

The FIGURE is a schematic illustration of a dual centrifugal compressor vapor compression refrigeration system with a control system for initiating a surge correction of the refrigeration system according to the principles of the present invention.

DESCRIPTION OF THE PREFERRED EMBODIMENT

Referring to the FIGURE, a vapor compression refrigeration system 1 is shown having two centrifugal compressors 32 with a control system 33 for varying the capacity of the refrigeration system 31 and initiating a surge correction according to the principles of the present invention. As shown in the FIGURE, the refrigeration system 31 includes a condenser 34, an evaporator 35 and a poppet valve 36. In operation, compressed gaseous refrigerant is discharged from one or both compressors 32 through compressor discharge lines 37 to the condenser 34 wherein the gaseous refrigerant is condensed by relatively cool condensing water flowing through tubing 38 in the condenser 34. The condensed liquid refrigerant from the condenser 34 passes through the poppet valve 36, which forms a liquid seal to keep condenser vapor from entering the evaporator and to maintain the pressure difference between the condenser and the evaporator, in refrigerant line 39 to evaporator 35. The liquid refrigerant in the evaporator 35 is evaporated to cool a heat transfer fluid, such as water or glycol, flowing through tubing 10 in the evaporator 35. This chilled heat transfer fluid is used to cool a building or is used for other such purposes. The gaseous refrigerant from the evaporator 35 flows through one or both compressor suction lines 11 back to either or both compressors 32 under the control of compressor inlet guide vanes 12. The gaseous refrigerant entering the compressor 32 through the guide vanes 12 is compressed by the compressor 32 and discharged from the compressor 32 through the compressor discharge line 37 to complete the refrigeration cycle. This refrigeration cycle is continuously repeated during normal operation of the refrigeration system 31.

The compressor inlet guide vanes 12 are normally opened and closed by a guide vane actuator 14 controlled by the capacity control system 33 which comprises a system interface board 16, a processor board 17, a set point and display board 18, and an analog/digital converter 19. Also, temperature sensor 13 for sensing the temperature of the heat transfer fluid leaving the evaporator 35 through the tubing 10 and temperature sensor 15 for sensing the temperature of the heat transfer fluid entering the evaporator 35 through the tubing 10, are connected by electrical lines 20 and 22 directly to the A/D converter 19 for controlling single compressor operation. However, during dual compressor conditions, the capacity control system 33 changes to surge control in which the A/D converter 19 receives signals from motor current monitors 28 through electrical lines 24 and 26 corresponding to the electrical motor current of the running compressors.

Preferably, the temperature sensors 13 and 15 are temperature responsive resistance devices such as thermistors having their sensing portions located in the heat transfer fluid in the tubing 10 in the evaporator 35 with their resistances monitored by the A/D converter, as shown in the FIGURE. Of course, as will be readily apparent to one of ordinary skill in the art to which the present invention pertains, the temperature sensors 13 and 15 may be any of a variety of temperature sensors suitable for generating a signal indicative of the temperature of the heat transfer fluid in the tubing 10 in the evaporator 35 for supplying these generated signals to the A/D converter 19. Further, the motor current monitors 28 are preferably current transformer devices manufactured by Westinghouse.

The processor board 17 may be any device, or combination of devices, capable of receiving a plurality of input signals, processing the received input signals according to preprogrammed procedures, and producing desired output control signals in response to the received and processed input signals, in a manner according to the principles of the present invention. For example, the processor board 17 may comprise a microcomputer, such as a model 8031 microcomputer available from Intel Corporation which has a place of business at Santa Clara, Calif.

Also, preferably, the A/D converter 19 is a dual slope A/D converter which shall process all analog inputs and which is suitable for use with the processor board 17. Also, it should be noted that, although the A/D converter 19 is shown as a separate module in the FIGURE, this A/D converter 19 may be physically part of the processor board 17 in an actual capacity control system 33.

Further, preferably, the set point and display board 18 comprises a visual display, including, for example, light emitting diodes (LED's) or liquid crystal display (LCD's) devices forming a multi-digit display which is under the control of the processor board 17. Also, the set point and display board 18 includes a device, such as a key pad which serves as a data entry port as well as a programming tool, and permits selection of lead compressor and lag compressor.

Still further, preferably, the system interface board 16 includes at least one switching device, such as a model SC-140 triac available from General Electric, Corp. which has a place of business at Auburn, N.Y., which is used as a switching element for controlling a supply of electrical power (not shown) through electrical lines 21 to the guide vane actuators 14. The triac switches on the system interface board 16 are controlled in response to control signals received by the triac switches from the processor board 17. In this manner, electrical power is supplied through the electrical lines 21 to the guide vane actuator 14 under control of the processor board 17 to operate the guide vane actuator 14 in the manner according to the principles of the present invention which is described in detail below. Of course, as will be readily apparent to one of ordinary skill in the art to which the present invention pertains, switching devices other than triac switches may be used in controlling power from from the power supply (not shown) through the electrical lines 21 to the guide vane actuator 14 in response to output control signals from the processor board 17.

The guide vane actuator 14 may be any device suitable for driving the guide vanes 12 toward either their open or closed position in response to electrical power signals received via electrical lines 21. For example, the guide vane actuator 14 may be an electric motor, such as a model MC-351 motor available from the Barber-Colman Company having a place of business in Rockford, Ill., for driving the guide vanes 12 toward either their open or closed position depending on which one of two traic switches on the system interface board 16 is actuated in response to control signals received by the triac switches from the processor board 17. The guide vane actuator 14 drives the guide vanes 12 toward either their fully open or fully closed position at a constant, fixed rate only during that portion of a selected base time interval during which the appropriate traic switch on the system interface board 16 is actuated.

Operation of a refrigeration machine utilizing multiple centrifugal compressors, connected in parallel, wherein one of the compressors is designated "lead" and the other compressor is designated "lag" is generally kept under control by a lead/lag algorithm that senses the percent of full load electrical motor current that the lead compressor is running and controls the guide vanes of the lag compressor until the percent of full load motor current of the lag compressor matches the percent of full load motor current of the lead compressor. However, the guide vanes of the lead compressor are normally controlled in response to leaving chilled water temperature.

During a surge condition, however, for example when the lag compressor surges, operation of the system control changes to a surge control override scheme whenever the lag compressor percent motor amps are below the lead compressor motor amps by more than a selected percentage, e.g. more than 20 percentage points. If the lag compressor motor amps are below the selected percentage for a predetermined period of time, e.g. two minutes, the surge control override scheme drives the lead compressor guide vanes closed for a specified period of time, e.g. three minutes, or until the lag compressor current increases by a particular percentage, e.g. ten percentage points. If after the specified period of time the lag compressor motor current has not increased by the particular percentage, the lag compressor shall be shut down and the lead compressor control shall revert back to a temperature control. If, however, the lag compressor motor current increases by the particular percentage within the specified period of time, than the surge control override scheme shall revert back to normal temperature control. If the lag current again drops below the selected percentage for the predetermined period of time, the normal temperature control will again change to a surge control override scheme as described above. However, if the lag current drops below the selected percentage for a third time, then the lag compressor is shut down and can not be restarted without operator action.

While this invention has been described with reference to a particular embodiment disclosed herein, it is not confined to the details set forth herein and this application is intended to cover any modifications or changes as may come within the scope of the invention.

What is claimed is:

1. A surge control system for a refrigeration system of the type which includes dual centrifugal compressors wherein one compressor is selected as a lead compressor and the other compressor is selected as a lag compressor, comprising:

means for generating a first control signal which is a function of the motor current of the lead compressor;

means for generating a second control signal which is a function of the motor current of the lag compressor; and processor means for receiving said first and second control signals for processing the received signals according to preprogrammed procedures, and for generating a control signal for controlling the load on the lead compressor when said second control signal is less than said first control signal by a percentage for a predetermined period of time.

2. A surge control system as set forth in claim 1 wherein said selected percentage is equal to or more than twenty percentage points and said predetermined period of time is equal to or greater than two minutes.

3. A surge control system as set forth in claim 2 further comprising guide vanes of the lead compressor wherein said generated control signal closes said guide vanes for a specified period of time or until said second control signal increases by a particular percentage.

4. A surge control system as set forth in claim 3 wherein said specified period of time is equal to or greater than three minutes and said particular percentage is equal to or greater than ten percentage points.

5. In a refrigeration system having lead and lag centrifugal compressors each with inlet guide vanes, an evaporator, a liquid heat exchanger in the evaporator, and a condenser, a method of controlling the surge of the lag compressor comprising the steps of:

sensing the motor current of the lead compressor;

sensing the motor current of the lag compressor;

producing a control signal for controlling the lead compressor when the lag compressor is in surge that is a function of the difference between said motor current of the lead compressor and said motor current of said lag compressor; and varying the capacity of the lead compressor in response to said control signal.

6. A method of controlling the surge of the lag compressor set forth in claim 5 wherein the step of producing a control signal includes the step of producing said control signal when said motor current of said lag compressor is less than said motor current of said lead compressor by twenty percentage points for a period of two minutes.

* * * * *